US008609966B2

(12) United States Patent
Lucas

(10) Patent No.: US 8,609,966 B2
(45) Date of Patent: Dec. 17, 2013

(54) TRANSPOSABLE CAPO SYSTEM AND METHOD

(76) Inventor: Richard C. Lucas, Ashland, OR (US)

( * ) Notice: Subject to any disclaimer, the term of this patent is extended or adjusted under 35 U.S.C. 154(b) by 314 days.

(21) Appl. No.: 13/086,371

(22) Filed: Apr. 13, 2011

(65) Prior Publication Data

US 2012/0255419 A1 Oct. 11, 2012

Related U.S. Application Data

(60) Provisional application No. 61/342,783, filed on Apr. 20, 2010.

(51) Int. Cl.
*G10D 3/00* (2006.01)

(52) U.S. Cl.
USPC ..... 84/318

(58) Field of Classification Search
USPC ..... 84/318
See application file for complete search history.

(56) References Cited

U.S. PATENT DOCUMENTS

| | | | | |
|---|---|---|---|---|
| 3,228,133 | A * | 1/1966 | Baermann | 40/621 |
| 4,798,119 | A | 1/1989 | Leifheit | |
| 5,056,397 | A | 10/1991 | Leifheit | |
| 5,623,110 | A | 4/1997 | Hoglund et al. | |
| 5,986,190 | A | 11/1999 | Wolff et al. | |
| 6,013,868 | A * | 1/2000 | Sims et al. | 84/318 |
| 6,723,905 | B2 | 4/2004 | Gillis | |
| 6,998,526 | B1 * | 2/2006 | Sims et al. | 84/318 |
| 7,358,429 | B2 | 4/2008 | Thoen | |
| 2006/0191399 | A1 | 8/2006 | Miyaki | |

* cited by examiner

*Primary Examiner* — Jianchun Qin
(74) *Attorney, Agent, or Firm* — Jerry Haynes Law

(57) ABSTRACT

A transposable capo system for a stringed musical instrument includes at least one magnetic capo stud having a string slot adapted to receive a string on the instrument.

19 Claims, 4 Drawing Sheets

TRANSPOSABLE CAPO SYSTEM AND METHOD

CROSS-REFERENCE TO RELATED APPLICATIONS

This application claims the benefit of U.S. provisional application No. 61/342,783, filed Apr. 20, 2010 and entitled "TRANSPOSABLE CAPO SYSTEM", which provisional application is hereby incorporated by reference in its entirety.

FIELD OF THE INVENTION

The disclosure generally relates to capos for raising the pitch of strings on stringed musical instruments such as guitars, banjoes and violins, for example. More particularly, the disclosure relates to a transposable capo system and method in which transposable capos magnetically hold strings of a stringed musical instrument against a finger board or other component of the instrument to impart a capo effect to individual strings or groups of strings on the instrument.

BACKGROUND OF THE INVENTION

A capo is a device which is used to raise the pitch of strings on a stringed musical instrument. Capos can be used to change the key of the instrument or create drone strings while leaving the fingers of the instrument player free for additional techniques. A conventional capo mechanically holds in unison the strings of an instrument in a "stopped" position against a finger board or other component of the instrument. While capos which affect the pitch of only a selected string or strings on an instrument are known in the art, these capos are typically limited to application only at certain locations on the strings and may also require the use of frames, springs and/or other clamping mechanisms for their application.

Accordingly, a transposable capo system and method in which transposable capos magnetically hold strings of a stringed musical instrument against a finger board or other component of the instrument to impart a capo effect to individual strings or groups of strings on the instrument are needed.

SUMMARY OF THE INVENTION

The disclosure is generally directed to a transposable capo system for a stringed musical instrument. An illustrative embodiment of the transposable capo system includes at least one magnetic capo stud having a string slot adapted to receive a string on the instrument.

In some embodiments, the transposable capo system may include a magnetic inlay panel adapted for attachment to the instrument and at least one magnetic capo stud adapted for magnetic attachment to the magnetic inlay panel and having a string slot adapted to receive a string on the instrument.

The disclosure is further generally directed to a transposable capo method. An illustrative embodiment of the method includes providing at least one transposable capo having a magnetic capo body and a string slot in the capo body, providing a stringed musical instrument, selecting at least one location for placement of at least one transposable capo on at least one string of the instrument, inserting a string of the instrument in the string slot of the transposable capo and magnetically attaching the transposable capo to a finger board of the instrument.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 10:
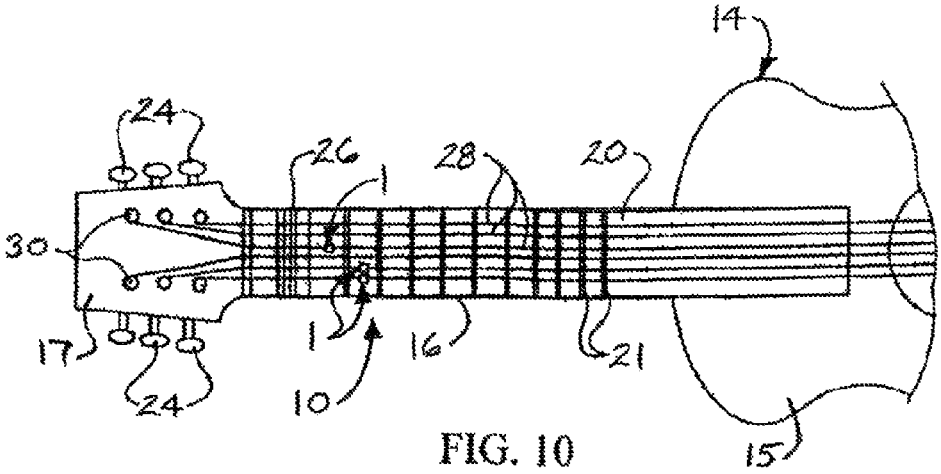
FIG. 10 is a top view, partially in section, of a stringed musical instrument, with multiple transposable capos of the transposable capo system placed at various locations on strings of the instrument.
Figure 11:
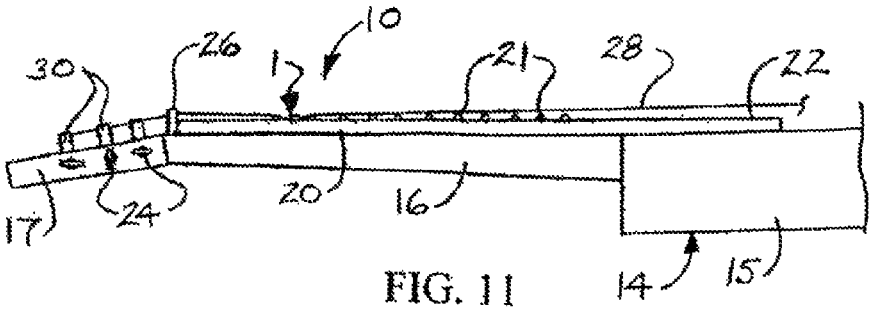
FIG. 11 is a side view, partially in section, of a stringed musical instrument, with a transposable capo of the transposable capo system holding a string against a finger board of the instrument at a selected location along the string.
Figure 12:
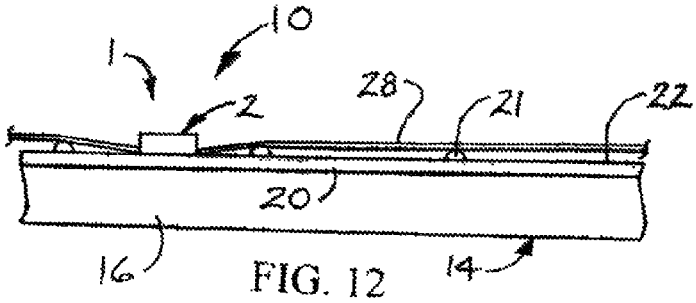
FIG. 12 is an enlarged sectional view illustrating the transposable capo of the transposable capo system holding the string against the finger board of the instrument as illustrated in FIG. 11.

Referring initially to FIGS. 10-12 of the drawings, an illustrative embodiment of the transposable capo system is generally indicated by reference numeral 10. The transposable capo system 10 includes at least one transposable capo 1 which can be placed against a string 28 on a stringed musical instrument 14 such as a guitar, banjo or violin, for example and without limitation, to shorten or "stop" the string 28 and achieve a capo effect (raising the pitch of the string 28 accordingly or create a drone string), as will be hereinafter described. The stringed musical instrument 14 may be conventional and typically includes an instrument body 15, an elongated instrument neck 16 extending from the instrument body 15 and an instrument head 17 which terminates the instrument neck 16. A finger board 20 may be provided on the instrument neck 16. Multiple frets 21 may be provided at spaced-apart intervals along the length of the finger board 20. The finger board 20 has a finger board surface 22 (FIG. 11) which may be magnetic or non-magnetic.

The strings 28 are anchored at a first end to the instrument body 15 of the stringed musical instrument 14. The strings 28 extend over the finger board 20 and may engage a string nut 26 at the junction between the instrument head 17 and the instrument neck 16. The second end of the strings 28 may be attached to spindles 30 on the instrument head 17. Tuning pegs 24 on the instrument head 17 may be rotated to rotate the respective spindles 30 and tune the springs 28 which are attached to the respective spindles 30 in the conventional manner.

Referring next to FIGS. 1-6 of the drawings, each transposable capo 1 of the transposable capo system 10 includes a capo stud 2 which may be generally rectangular. The capo stud 2 of each transposable capo 1 is a magnetic material. In some embodiments, the capo stud 2 may be a high grade neodymium magnet. The capo stud 2 may have a generally flat or planar lower surface 3, a generally flat or planar upper surface 6 and parallel side surfaces 4 and parallel end surfaces 5 extending between the lower surface 3 and the upper surface 6. In some embodiments, the capo stud 2 may have dimensions of about ¼"×¼"×⅛", although these dimensions may vary according to the particular application of the transposable capo 1.

Figure 1:
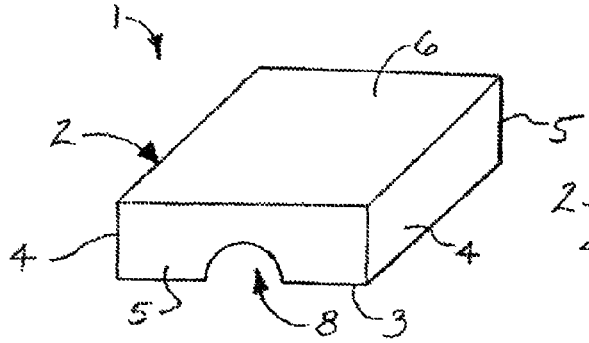
FIG. 1 is a perspective view of a transposable capo of an illustrative embodiment of the transposable capo system.
Figure 2:
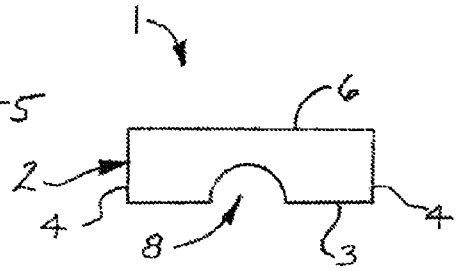
FIG. 2 is a front view of the transposable capo.
Figure 3:
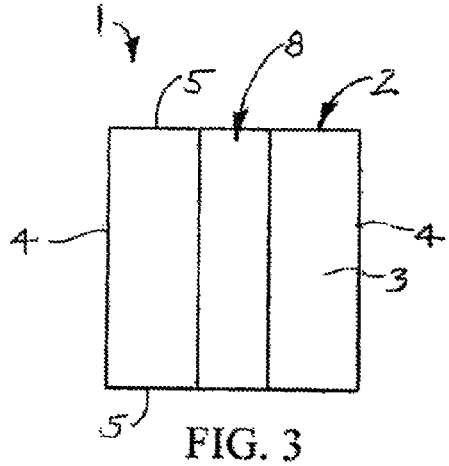
FIG. 3 is a bottom view of the transposable capo.
Figure 4:
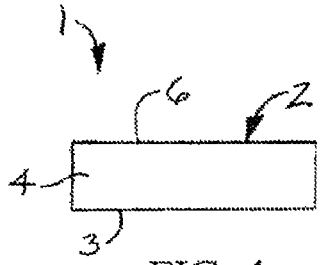
FIG. 4 is a side view of the transposable capo.
Figure 5:
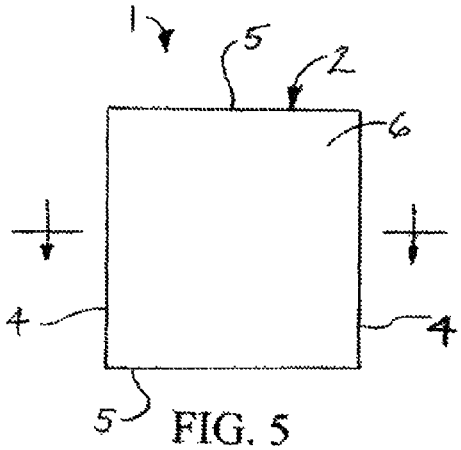
FIG. 5 is a top view of the transposable capo.
Figure 6:
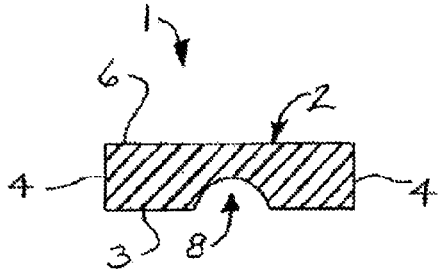
FIG. 6 is a sectional view, taken along section lines 6-6 in FIG. 5.
Figure 7:
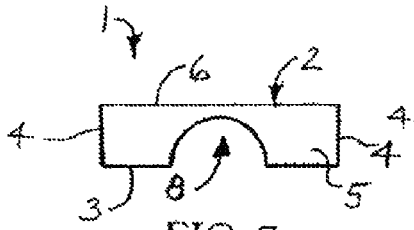
FIGS. 7-9 are front views of transposable capos having string slots with various sizes to accommodate strings of different gauges on a stringed musical instrument.
Figure 8:
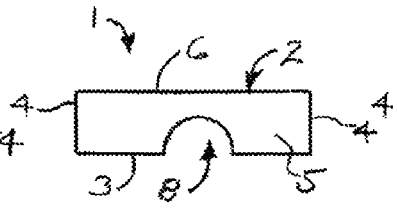
Figure 9:
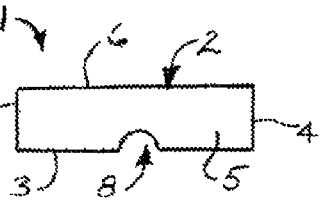

A string slot 8 may be provided in the lower surface 3 of the capo stud 2. As illustrated in FIG. 3, the string slot 8 may extend from one end surface 5 to the other end surface 5, generally between and in parallel relationship to the side surfaces 4 of the capo stud 2. As illustrated in FIG. 6, the string slot 8 may be generally semicircular or V-shaped in cross-section. Each string slot 8 may be adapted to receive a corresponding string 28 of the stringed musical instrument 14 in use of the transposable capo system 10, which will be hereinafter described. As illustrated in FIGS. 7-9, the string slot 8 in the capo stud 2 of each transposable capo 1 may have a selected size or radius to accommodate strings 28 having various gauges or thicknesses on different types of instruments 14 or on the same instrument 14.

Figure 13:
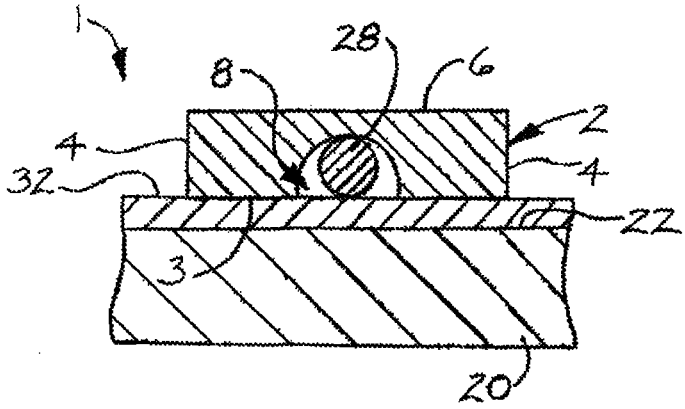
FIG. 13 is a cross-sectional view of a transposable capo, a string of a stringed musical instrument and a portion of the stringed instrument to which the capo is applied, with the string of the instrument extending through a string slot in the capo as the capo holds the string against the stringed instrument, further illustrating a magnetic inlay panel provided on the instrument to magnetically attract the capo.
Figure 14:
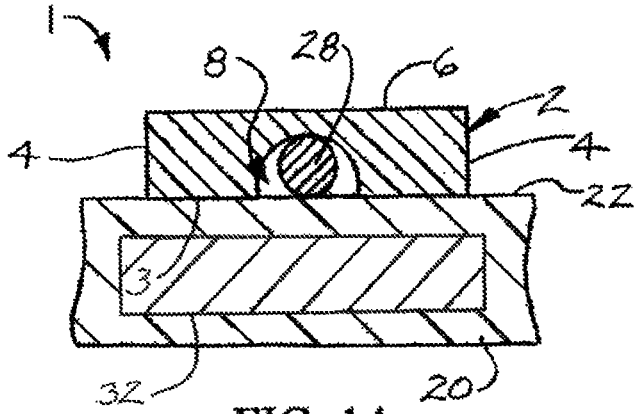
FIG. 14 is a cross-sectional view of a transposable capo, a string of a stringed musical instrument and a portion of the stringed instrument to which the capo is applied, with the string of the instrument extending through a string slot in the capo as the capo is magnetically secured to the instrument holds the string against the instrument further illustrating a magnetic panel (in phantom) inlayed from beneath the fingerboard.

Referring next to FIGS. 10-14 of the drawings, in exemplary application of the transposable capo system 10, at least one transposable capo 1 is placed in engagement with at least one string 28 to hold the string 28 against the finger board 20 and retune or raise the pitch of the string 28 according to the preferences of the user of the stringed musical instrument 14. In some applications, the transposable capo 1 or transposable capos 1 can be placed on one or multiple strings 28, respectively, to create drone strings as is known by those skilled in the art. Multiple transposable capos 1 can be placed on a corresponding number of strings 28 to create chords. Accordingly, in applications in which the finger board 20 of the instrument 14 has a magnetic finger board surface 22, as illustrated in FIGS. 11, 12 and 14, the lower surface 3 of the magnetic capo stud 2 of each transposable capo 1 is magnetically attached to the magnetic finger board surface 22. As the capo stud 2 is placed against the magnetic finger board surface 22, the string slot 8 in the lower surface 3 of the capo stud 2 receives the string 28 of the stringed musical instrument 14. Therefore, as illustrated in FIGS. 11 and 12, the capo stud 2 holds the string 28 against the finger board 20 and thus effectively shortens and retunes or raises the pitch of the string 28 or creates a drone string when the string 28 is plucked or strummed. The transposable capo 1 can be placed at any selected location along the length of the string 28 depending on the retuning capo effects which the user of the stringed musical instrument 14 desires to impart to the string 28 for a particular musical application.

As further illustrated in FIG. 10, in some applications, each of multiple transposable capos 1 of the transposable capo system 10 may be individually placed on respective strings 28 of the stringed musical instrument 14 according to the desired musical effects which are to be attained using the stringed musical instrument 14. Placement of a transposable capo 1 on each string 28 may change the key of the stringed musical instrument 14 or create drone strings. Because it stops a corresponding string 28, each transposable capo 1 does not hinder the fingering or sounding of other strings 28 along the finger board 20. Moreover, the capo stud 2 of each transposable capo 1 maintains a low profile and therefore does not restrict or interfere with fingering positions on strings 28 which are adjacent to the transposable capo 1. In some applications, the magnetic positive and negative polarity of the capo studs 2 of the transposable capos 1 may be alternated among the adjacent strings 28 to prevent "stacking" when positioned in close adjacent relationship to each other.

In some applications, the stringed musical instrument 14 may have a finger board 20 with a non-magnetic finger board surface 22. Accordingly, as illustrated in FIG. 13, a magnetic inlay panel 32 may be placed over the non-magnetic finger board surface 22 of the finger board 20. The capo stud 2 of each transposable capo 1 may be magnetically attached to the magnetic inlay panel 32 to hold the selected string 28 against the magnetic inlay panel 32 and retune the string 28 as was heretofore described with respect to FIGS. 11 and 12.

Figure 15:
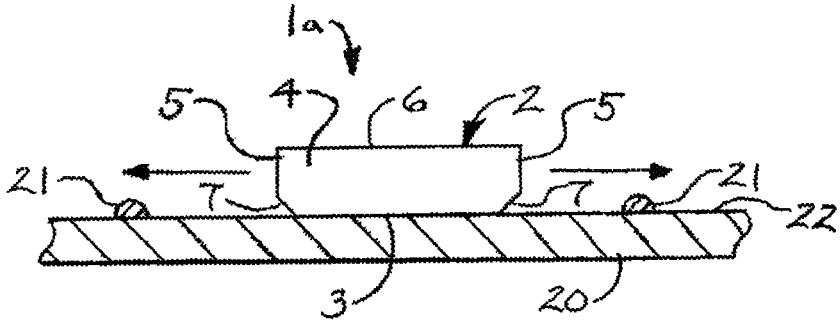
FIG. 15 is a side view of an alternative, chamfered embodiment of the transposable capo, placed on a finger board of a stringed musical instrument having multiple frets and further illustrating movement capability of the capo over the frets on the finger board.

Referring next to FIG. 15 of the drawings, an alternative illustrative embodiment of the transposable capo which is suitable for implementation of the transposable capo system 10 is generally indicated by reference numeral 1*a*. The transposable capo 1*a* includes a capo stud 2 having a bevel or chamfer 7 at each front and rear edge between the lower surface 3 and the corresponding end surface 5. Therefore, on a stringed musical instrument 14 the finger board 20 of which includes multiple frets 21, the chamfers 7 enable the capo stud 2 to be selectively slid over the frets 21 in either direction on the string 28 on which it is placed, as indicated by the arrows, without otherwise requiring detachment of the capo stud 2 from the finger board 20 and replacement on the finger board 20 at the selected location to achieve the desired retuning effect of the string 28.

It will be appreciated by those skilled in the art that the transposable capos 1 of the transposable capo system 10 can be quickly and easily placed on individual strings 28 of a stringed musical instrument 14 and moved into position and repositioned on and removed from the strings 28. The transposable capos 1 can be used to retune a selected string 28 at a particular fret 21 to create a drone string. In other applications, the transposable capos 1 can be used to retune selected strings 28 at varying fret locations to form chords or create multiple drone strings. The capability of the transposable capo system 10 to fret a string 28 at any position on the finger board 20 provides the advantage of not hindering the fingering or sounding of other strings 28 along the finger board 20 and also renders the transposable capo system 10 applicable to a variety of stringed musical instruments 14. Moreover, the low profile of the capo stud 2 of each transposable capo 1 prevents or minimizes interference of fingering positions adjacent to the transposable capos 1. Additionally, the individual capo capabilities of the transposable capo system 10 promote versatility in enhancing the capacity to create various open tuning effects while maintaining standard tuning capability for playing other chords, leads, melodies and harmonics. If desired, the transposable capo system 10 may be applied to non-standard tunings as well.

It will be further appreciated by those skilled in the art that the magnetic inlay panel 32 may be affixed to the finger board 20 in applications in which the finger board surface 22 of the finger board 20 is non-magnetic. In various applications, the magnetic inlay panel 32 may be inset, overlayed or positioned "blind" from underneath the fingerboard 20 (FIG. 14 shown in phantom) for use in conjunction with the transposable capos 1. In some applications, the magnetic inlay panel 32 may be attached to the finger board 20 using fasteners, adhesives, flanges and grooves and/or any other suitable attachment technique known by those skilled in the art. Inlays, laminations and veneers may be suitable applications for the magnetic inlay panel 32. Finger boards 20 of existing instruments 14 may be readily retrofitted and new instruments 14 may greatly benefit from having this capability integrated into their construction.

Custom and hybrid instruments may be produced to exploit the benefits of the transposable capo system 10. Replacement ferrous, magnetic or electromagnetically outfitted necks 16 can be made for swapping out with existing instruments 14. Furthermore, kits may be offered for modification of existing necks 16. New instruments may include the option of accommodating the transposable capo system 10 in many and diverse ways including but not limited to facilities for storage of the capo studs 2 or re-positional magnetic index marks for the finger board 20.

A ferrous or magnetically outfitted finger board 20 allows any position on the finger board 20 to be used even on the uppermost register. This revolutionizes the playing of a particular instrument by encouraging different fingering and techniques. The transposable capo system 10 allows variable yet precise placement of the transposable capos 1 which may be utilized even on fretless instruments such as violins, violas, cellos and basses, for example and without limitation.

Variations in the construction of the capo studs 2 among different transposable capos 1 may be employed to allow individual string-muting if desired. Embellishments to the manufacturing of the capo studs 2 may include a muting option, a cam or set-screw slot adjustment, a slot lining material to resist vibration and etching and color-coding and may lend themselves to artistic personalization much like jewelry.

Figure 16:
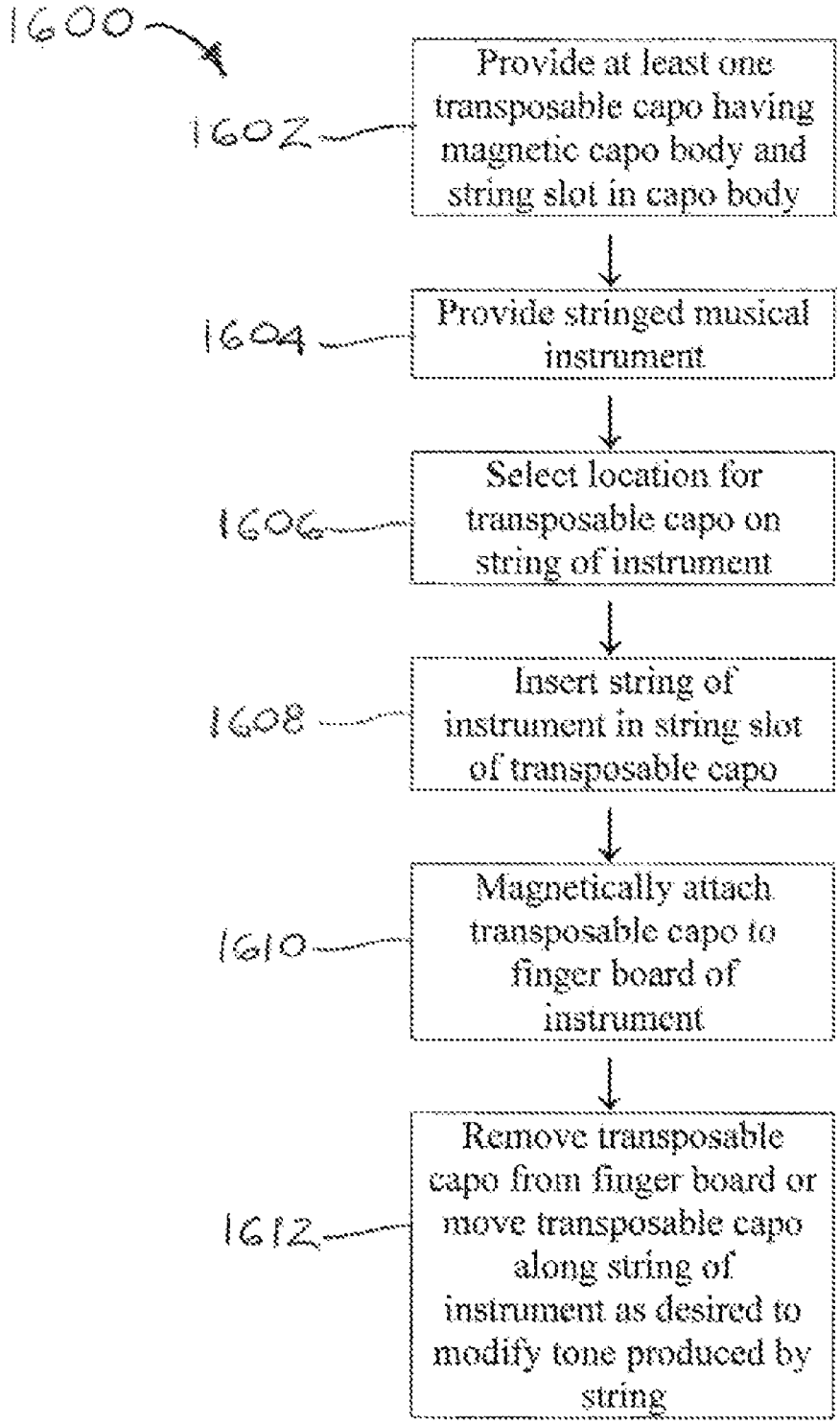
FIG. 16 is a flow diagram of an illustrative embodiment of a transposable capo method.

Referring next to FIG. 16 of the drawings, a flow diagram 1600 of an illustrative embodiment of a transposable capo method is illustrated. In block 1602, at least one transposable capo having a magnetic capo body and a string slot in the capo body is provided. In block 1604, a stringed musical instrument is provided. In block 1606, a location for each transposable capo on a corresponding string of the instrument is selected. In block 1608, a string of the instrument is inserted into the string slot of each transposable capo. In block 1610, the transposable capo is magnetically attached to the finger board of the instrument. In some embodiments, a magnetic inlay panel may be provided on the instrument and the transposable capo may be magnetically attached to the magnetic inlay panel. In block 1612, the transposable capo may be removed from the finger board or moved along the string of the instrument as desired to modify the tone produced by the string.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A transposable capo system for a stringed musical instrument, comprising:

a plurality of magnetic capo studs having opposite exterior magnetic side surfaces of opposite magnetic fields influenced by alternating polarities of the adjacent studs and a string slot adapted to receive a string on the instrument, wherein the magnetic capo surface is co-extensive with the capo stud side surface area; and wherein the plurality of magnetic capo studs are positional among adjacent strings of the musical instrument with the opposite magnetic fields of the opposite exterior magnetic side surfaces of the respective magnetic capo studs disposed in alternating relationship to each other to eliminate magnetic side field interference.

2. The transposable capo system of claim 1 wherein the string slot is generally V-shaped in cross-section.

3. The transposable capo system of claim 1 wherein the capo stud is generally rectangular.

4. The transposable capo system of claim 3 wherein the capo stud comprises a pair of end surfaces extending between the pair of exterior magnetic side surfaces, a top surface and a bottom surface.

5. The transposable capo system of claim 4 wherein the string slot is provided in the bottom surface of the capo stud.

6. The transposable capo system of claim 5 wherein the string slot extends from a first one of the end surfaces to a second one of the end surfaces.

7. The transposable capo system of claim 1 further comprising a pair of chamfers in the capo stud.

8. The transposable capo system of claim 1 wherein the capo stud comprises a neodymium magnet.

9. A transposable capo system for a stringed musical instrument, comprising:

a magnetic inlay panel adapted for attachment to the instrument; a plurality of magnetic capo studs adapted for magnetic attachment to the magnetic inlay panel and having opposite exterior magnetic side surfaces of opposite magnetic fields influenced by alternating polarities of the adjacent studs and a string slot adapted to receive a string on the instrument, wherein the magnetic capo surface is co-extensive with the capo stud side surface area; and wherein the plurality of magnetic capo studs are positional among adjacent strings of the musical instrument with the opposite magnetic fields of the opposite exterior magnetic side surfaces of the respective magnetic capo studs disposed in alternating relationship to each other to eliminate magnetic side field interference.

10. The transposable capo system of claim 9 wherein the string slot is generally V-shaped in cross-section.

11. The transposable capo system of claim 9 wherein the capo stud is generally rectangular.

12. The transposable capo system of claim 11 wherein the capo stud comprises a pair of end surfaces extending between the pair of exterior magnetic side surfaces, a top surface and a bottom surface.

13. The transposable capo system of claim 12 wherein the string slot is provided in the bottom surface of the capo stud.

14. The transposable capo system of claim 13 wherein the string slot extends from a first one of the end surfaces to a second one of the end surfaces.

15. The transposable capo system of claim 9 further comprising a pair of chamfers in the capo stud.

16. The transposable capo system of claim 9 wherein the capo stud comprises a neodymium magnet.

17. A transposable capo method, comprising:

providing a plurality of transposable capos having a magnetic capo body with a pair of opposite exterior magnetic side surfaces of opposite magnetic fields influenced by alternating polarities of the adjacent capos and a string slot in the capo body, wherein the magnetic capo surface is co-extensive with the capo stud side surface area;

providing a stringed musical instrument;

selecting a plurality of locations for placement of the plurality of transposable capos on a plurality of strings, respectively, of the instrument;

positioning the plurality of transposable capos among adjacent strings of the musical instrument with the opposite magnetic fields of the opposite exterior magnetic side surfaces of the respective transposable capos disposed in alternating relationship to each other to eliminate magnetic side field interference;

inserting a string of the instrument in the string slot of each o3 the transposable capos; and magnetically attaching the plurality of transposable capos to a finger board of the instrument.

18. The transposable capo method of claim 17 wherein magnetically attaching the transposable capo to a finger board of the instrument comprises providing a magnetic inlay panel on the instrument and magnetically attaching the transposable capo to the magnetic inlay panel.

19. The transposable capo method of claim 17 further comprising modifying at least one tone produced by at least one string of the instrument by moving at least one of the transposable capos along the string.

* * * * *